US011932974B2

(12) United States Patent
Reimann et al.

(10) Patent No.: US 11,932,974 B2
(45) Date of Patent: Mar. 19, 2024

(54) METHOD FOR PRODUCING COLD CUT TEXTILE WEBS

(71) Applicant: Textilma AG, Stansstad (CH)

(72) Inventors: Robert Reimann, Munchwilen (CH); Bernhard Engesser, Niederwil (CH)

(73) Assignee: Textilma AG, Stansstad (CH)

( * ) Notice: Subject to any disclaimer, the term of this patent is extended or adjusted under 35 U.S.C. 154(b) by 336 days.

(21) Appl. No.: 17/602,144

(22) PCT Filed: Apr. 7, 2020

(86) PCT No.: PCT/EP2020/059944
§ 371 (c)(1),
(2) Date: Mar. 29, 2022

(87) PCT Pub. No.: WO2020/208047
PCT Pub. Date: Oct. 15, 2020

(65) Prior Publication Data

US 2022/0235499 A1 Jul. 28, 2022

(30) Foreign Application Priority Data

Apr. 10, 2019 (EP) ..... 19168492

(51) Int. Cl.
*D03D 49/70* (2006.01)
*D03D 35/00* (2006.01)
*D03J 1/08* (2006.01)

(52) U.S. Cl.
CPC ..... *D03J 1/08* (2013.01); *D03D 35/00* (2013.01)

(58) Field of Classification Search
CPC ..... D03J 1/08; D03D 35/00; D03D 47/40; D03D 21/00; D03D 15/49; D03D 15/587; D03D 49/70
See application file for complete search history.

(56) References Cited

U.S. PATENT DOCUMENTS 572,674 A * 12/1896 Browning ..... D03D 47/40 139/117
1,393,539 A * 10/1921 Jourdain ..... D03D 49/70 139/263

(Continued)

FOREIGN PATENT DOCUMENTS

CH 358760 A 11/1961
CH 490 541 5/1970

(Continued)

OTHER PUBLICATIONS

Written Opinion of the International Searching Authority in related PCT/EP2020/059944.

*Primary Examiner* — Robert H Muromoto, Jr.
(74) *Attorney, Agent, or Firm* — George Pappas; Barrett McNagny LLP

(57) ABSTRACT

In order to produce a plurality of fabric strips (22) from a fabric (20) during the manufacturing process thereof, a method is proposed which utilizes the steps of: inserting weft threads (24) into the open warp thread shed, laying of a plurality of cover threads (30, 34) in a zigzag shape by a plurality of feed needles (32, 36), cutting the fabric (20) in the drawing-off direction into a plurality of woven strips (22), and pulling off the warp threads (60) that are located between the cutting-side laying points of the cover threads and the cutting device. This method can be implemented in a particularly advantageous manner if, in addition to the cover thread (30, 34) introduced in zigzag manner, a further cover thread (70) is introduced at each fabric edge (26) by a further feed needle in such manner that it is connected to the zigzag thread whereby the zigzag thread is prevented from fraying.

20 Claims, 8 Drawing Sheets

(56) References Cited

U.S. PATENT DOCUMENTS

| | | | | |
|---|---|---|---|---|
| 2,035,138 | A * | 3/1936 | Maxfield | D03J 1/08 28/165 |
| 3,128,797 | A * | 4/1964 | La Valley | D03D 49/70 139/266 |
| 3,712,344 | A * | 1/1973 | Kovacec | D03D 41/00 139/11 |
| 3,961,650 | A * | 6/1976 | Marowsky | D03J 1/08 139/291 C |
| 4,505,304 | A * | 3/1985 | Zust | D03D 49/70 83/658 |
| 7,992,596 | B2 * | 8/2011 | Khokar | D03D 49/60 139/420 R |
| 9,091,002 | B2 * | 7/2015 | Malloy | D03D 15/49 |
| 9,307,685 | B2 * | 4/2016 | Harris | D04C 1/06 |
| 9,771,672 | B2 * | 9/2017 | Ratsiri | D03D 15/267 |
| 10,132,012 | B2 * | 11/2018 | Thomas | D03D 15/587 |
| 10,149,418 | B2 * | 12/2018 | Harris | D03D 1/0088 |
| 10,357,933 | B2 * | 7/2019 | Malloy | H02G 3/0412 |
| 10,766,101 | B2 * | 9/2020 | Rambusch | B23K 26/21 |
| 10,808,338 | B1 * | 10/2020 | Yidi | D03D 15/283 |
| 11,268,217 | B2 * | 3/2022 | Woodruff | D03D 15/00 |
| 11,384,457 | B2 * | 7/2022 | Malloy | D03D 1/0043 |
| 2008/0257443 | A1 * | 10/2008 | Khokar | D03D 1/0094 139/443 |
| 2009/0113681 | A1 * | 5/2009 | Yidi, Jr. | D03D 35/00 28/143 |
| 2010/0035000 | A1 * | 2/2010 | Kirth | D03D 23/00 428/221 |
| 2013/0228248 | A1 * | 9/2013 | Malloy | D03D 1/0043 139/35 |
| 2014/0272218 | A1 * | 9/2014 | Thomas | D03D 1/0041 428/35.1 |
| 2016/0021799 | A1 * | 1/2016 | Harris | D04C 1/06 87/9 |
| 2016/0201232 | A1 * | 7/2016 | Harris | D03D 15/47 28/142 |
| 2016/0237601 | A1 * | 8/2016 | Ratsiri | D03J 1/06 |
| 2017/0036412 | A1 * | 2/2017 | Malloy | B32B 1/08 |
| 2017/0175304 | A1 * | 6/2017 | Woodruff | D03D 15/283 |
| 2017/0226669 | A1 * | 8/2017 | Korpela | D03D 15/587 |
| 2018/0135212 | A1 * | 5/2018 | Johanson | D03D 13/004 |
| 2018/0200831 | A1 * | 7/2018 | Rambusch | B23K 26/38 |
| 2019/0375181 | A1 * | 12/2019 | Malloy | D03D 3/02 |
| 2020/0385898 | A1 * | 12/2020 | Chiu | D03D 15/587 |
| 2022/0154371 | A1 * | 5/2022 | Woodruff | H01B 7/185 428/36.1 |
| 2022/0205147 | A1 * | 6/2022 | Phillips | D03D 15/587 |
| 2022/0307165 | A1 * | 9/2022 | Corain | D03D 49/70 |

FOREIGN PATENT DOCUMENTS

| | | | |
|---|---|---|---|
| DE | 2132853 | A | 1/1972 |
| DE | 2315333 | A1 | 10/1974 |
| DE | 3919218 | A1 | 12/1990 |
| DE | 195 10 818 | C1 | 7/1996 |
| GB | 1312332 | A | 4/1973 |
| WO | 97/13023 | | 4/1997 |
| WO | 98/18995 | | 5/1998 |
| WO | 2004/070103 | A1 | 8/2004 |
| WO | 2007030954 | A1 | 3/2007 |
| WO | 2011/095262 | A1 | 8/2011 |

* cited by examiner

METHOD FOR PRODUCING COLD CUT TEXTILE WEBS

This application claims priority from PCT application No. PCT/EP2020/059944 filed Apr. 7, 2020 which claims priority from European application No. EP 19168492.7 filed Apr. 10, 2019, the disclosures of which are incorporated herein by reference.

FIELD OF THE INVENTION

The invention relates to a method for producing cold cut woven fabric strips.

BACKGROUND OF THE INVENTION

For the production of relatively narrow woven fabric strips, in particular of woven fabric strips in the form of label strips lying next to each other, it is known and customary to initially produce a wider woven fabric and to then cut this into individual, narrower woven fabric strips. For the weaving of the wider woven fabric, weaving looms are used with a weft thread insertion by means of a gripper or by means of pneumatic weft thread insertion, but in principle also needle looms can be used effectively.

In order to avoid fraying of the cutting edge, for example in the case of simple cold cutting, as already proposed for example in WO 2007/030 954 A1, the cutting of the individual woven fabric strips is carried out according to the prior art—as often suggested—by melting the woven fabric material. In this process, the weft and warp threads fuse together and fraying of the cutting edge can thus be prevented. According to the prior art, resistance wires or heating wires are usually used as cutting elements, sometimes also hot knives. Cutting with ultrasound, which ultimately causes the melting process during cutting, is also known. In this respect, DE 2 132 853 A is referred to as prior art. Such a hot-cut edge is also proposed in CH 358 760 A, where a metal wire is woven in instead of one of the warp threads, which metal wire is then heated by means of an electric current when the woven fabric strips are cut, whereby the weft threads are melted through at this location. In this embodiment of CH 358 760 A, it appears essential that the weft threads are fused together at their cut ends, whereby a basically durable border is produced, albeit with a fused edge and thus with the disadvantages described above, which are to be avoided by the invention.

However, this method has the disadvantage that, due to the melted woven fabric material, a hard and rough fabric edge is produced, which is, in particular in the case of clothing textiles, for example in the case of sewn-in labels, uncomfortable when wearing the clothing.

In the prior art, there are known measures which attempted to minimize the roughening of the woven fabric edge or to eliminate it subsequently. In DE 2 315 333 A it is proposed that the fusion cutting element is resiliently arranged and changes its position depending on the force transmitted to the woven fabric. The electrical heating of the cutting element is then controlled, or minimized, depending on this position. DE 195 10818 C1 proposes temperature control of the heating wire by means of a temperature sensor and comparator, in order to minimize the heating power and to produce a cutting edge that is as gentle as possible. It has also been proposed to smooth the melted cutting edge by means of pressing members immediately after the cutting process. Thereby, the pressure should be applied by means of spring force or by deflecting the woven fabric. Reference is made here to WO 097/13023 A1, WO 098/18995 A1 and WO 2004/070103 A1. It has also been suggested, for example in DE 3 919 218 A, that the fused fabric edge can be so-to-speak "packed" by subsequent folding of the cut edge. However, the above-mentioned methods all have the disadvantage that with the smoothing of the fabric edge, insofar as it is successful, one has to accept thickened regions. Also the known cutting processes by means of ultrasound are, ultimately, hot cutting processes with the disadvantages described above.

Moreover, the hot cutting process described above is limited to those woven fabric materials in which both the warp and the weft consist of thermoplastic threads, i.e. of hot-cuttable threads. However, this is of course not the case in all applications, so that all the hot cutting processes described above can only be used in a restrictive manner.

In the older publication U.S. Pat. No. 572,674 A from 1896, a cold cutting of woven fabric strips is initially proposed, which probably already results from the possibilities of woven fabric materials at that time. In order to secure the cutting edges, it is proposed there to slide in, from the cutting edge into the woven fabric, additional edge-securing threads parallel to the weft threads without anchoring them in any way in the woven fabric. Due to the lack of anchoring, they can slip out of the edge again under mechanical stress, for example during washing, but also under other stress usually occurring on the fabric edge. With the measures proposed in U.S. Pat. No. 572,674 A, it is not possible to form a cutting path by means of the inserted edge-securing threads, which also means that the desired soft edge cannot be formed.

SUMMARY OF THE INVENTION

An object of the invention is to propose a manufacturing process for woven fabric strips, in which hot cutting can be dispensed with in view of the disadvantages and restrictions described above, but in which the cutting edge is nevertheless—unlike in U.S. Pat. No. 572,674 A—soft and safe against fraying.

The object is thereby achieved by a manufacturing process. Thereby, the measures of the invention initially have the consequence that by binding of the zigzag threads into the woven fabric by means of binding the corner points of the zigzag pattern into the woven fabric, a later fraying is prevented from the outset and that only in a further step the woven fabric strips are cut with a cold knife or an equivalent tool. During cold cutting, the threads of the woven fabric strips are neither partially melted nor melted through. This is an essential property of cold cutting in the sense of the present invention.

The measures of the invention are considerably improved if weft thread tails are formed by the cold cutting step or after the cold cutting step. The length of the weft thread tails at the fabric edge depends on the distance between the two adjacent zigzag structures, that means, on the number of warp threads lying loosely between the zigzag structure and the cutting edge. A velvet-type, soft edge is achieved by the weft tails described above.

In a first embodiment of the present invention, the warp threads that are lying loosely between the zigzag structure of the cover threads or the effect threads and the cutting edge in the woven fabric are simply pulled off subsequently and thereby the weft thread tails are formed.

In a first alternative embodiment, the warp threads that are located between the cutting-side laying points of the mentioned cover threads and the cutting edge are already pulled off downwards prior to the cutting process, whereby the weft thread tails are formed, these warp threads being permanently maintained in the low shed during the weaving process, and the pulling off occurring between the reed and the cutting device.

In a second alternative embodiment of the present invention, the warp threads that are located between the cutting-side laying points of the mentioned cover threads and the cutting edge are pulled off upwards or downwards already before the shed, that means, they are not woven in at all.

It is particularly advantageous in the sense of the present invention for certain applications to insert the cover threads under such high tension that the warp threads being bound by them are drawn together in weft direction in such a strong manner that a cutting path is formed and no excess warp threads need to be pulled off, but that nevertheless sufficiently long weft tails are formed.

Further advantageous embodiments of the weaving loom are described herein.

In order to prevent the zigzag structure from fraying on the fabric edge or being cut open during cutting, it is advantageous to keep the length of the weft thread tails not too short. Thereby, a length of at least two times 3-4 warp threads is advantageous.

Moreover, when using thermoplastic threads as weft threads, as warp threads, also as individual warp threads in the region of the intended edges of the individual woven fabric strips, and/or as the zigzag laid effect threads, it can be advantageous to melt the woven fabric prior to cold cutting and thus to fix it mechanically. It can also be advantageous to fuse the zigzag threads with the weft threads on the underside of the woven fabric by means of a heating element. It should be pointed out for this application that for this variant of the process—which is advantageous in certain applications—it is by no means necessary for all the thread elements to be meltable, in particular not for the warp threads or for all the warp threads. Moreover, it should be pointed out that in these advantageous embodiments—in contrast to the processes using hot cutting—the thermoplastic threads are only melted partially, but not melted through. In any case, there is no partial or even complete melting of the threads during the cutting step.

It can also be advantageous as an additional measure for even more reliable prevention of fraying of the fabric edge, to supply a textile thread with a hot-melt adhesive in the warp, in the weft and/or as an effect thread, and to hot-adhere the zigzag structure by means of a heating element, typically at temperatures below the melting point of the threads used in the fabric structure.

However, a variant of the method according to the present invention is particularly advantageous, in which, in addition to the zigzag thread, a further cover thread is introduced which is connected to the zigzag thread in such manner that it prevents fraying of the zigzag thread. This additional cover thread lies substantially along the warp thread direction, and it can—even with relatively short weft thread tails—prevent the zigzag thread from being detached from the weft thread tails. It is of course possible to combine this particularly advantageous embodiment of the invention with the above measures of adhering or fusing. However, it has been proven that this measure alone is already an effective means of preventing fraying.

It should be emphasized here that the additional cover thread can of course also be thermally fusible or provided with a hot-melt adhesive layer, in which case the above-mentioned thermal fixing is achieved additionally, in which case the weft threads, the zigzag shaped cover thread and/or individual or several warp threads can also be fusible or bonded with a hot melt layer.

The aforementioned elements, as well as those claimed and described in the following exemplary embodiments, to be used according to the invention, are not subject to any particular conditions by way of exclusion in terms of their size, shape, use of material and technical design, with the result that the selection criteria known in the respective field of application can be used without restrictions.

BRIEF DESCRIPTION OF THE DRAWINGS

Examples of the weaving loom will henceforth be described in more detail by reference to the drawings, which show.

DETAILED DESCRIPTION OF THE PREFERRED EMBODIMENTS OF THE INVENTION

Figure 1:
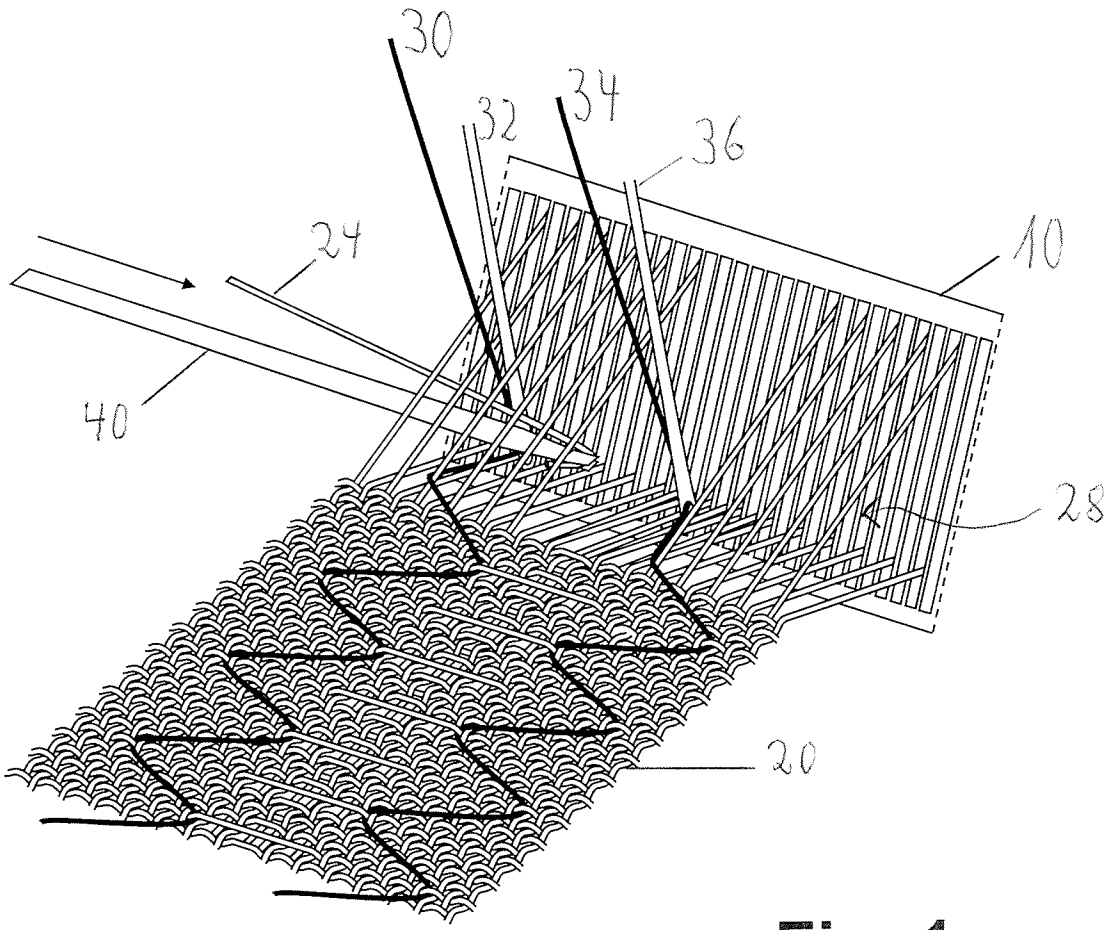
FIG. 1 the weaving process, with the insertion of the weft thread and the zigzag threads in the first position.
Figure 2:
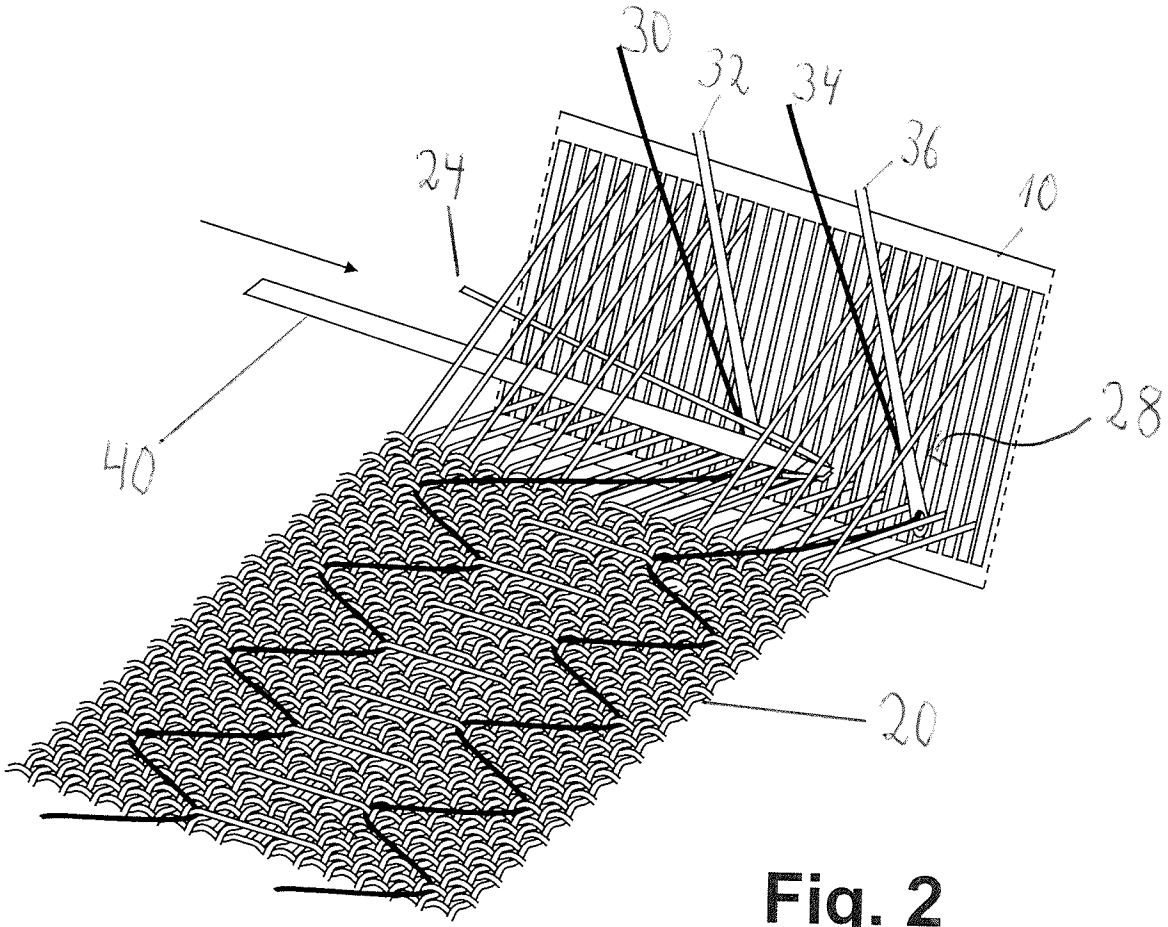
FIG. 2 the weaving process, with the insertion of the weft thread and the zigzag threads in the second position.
Figure 3:
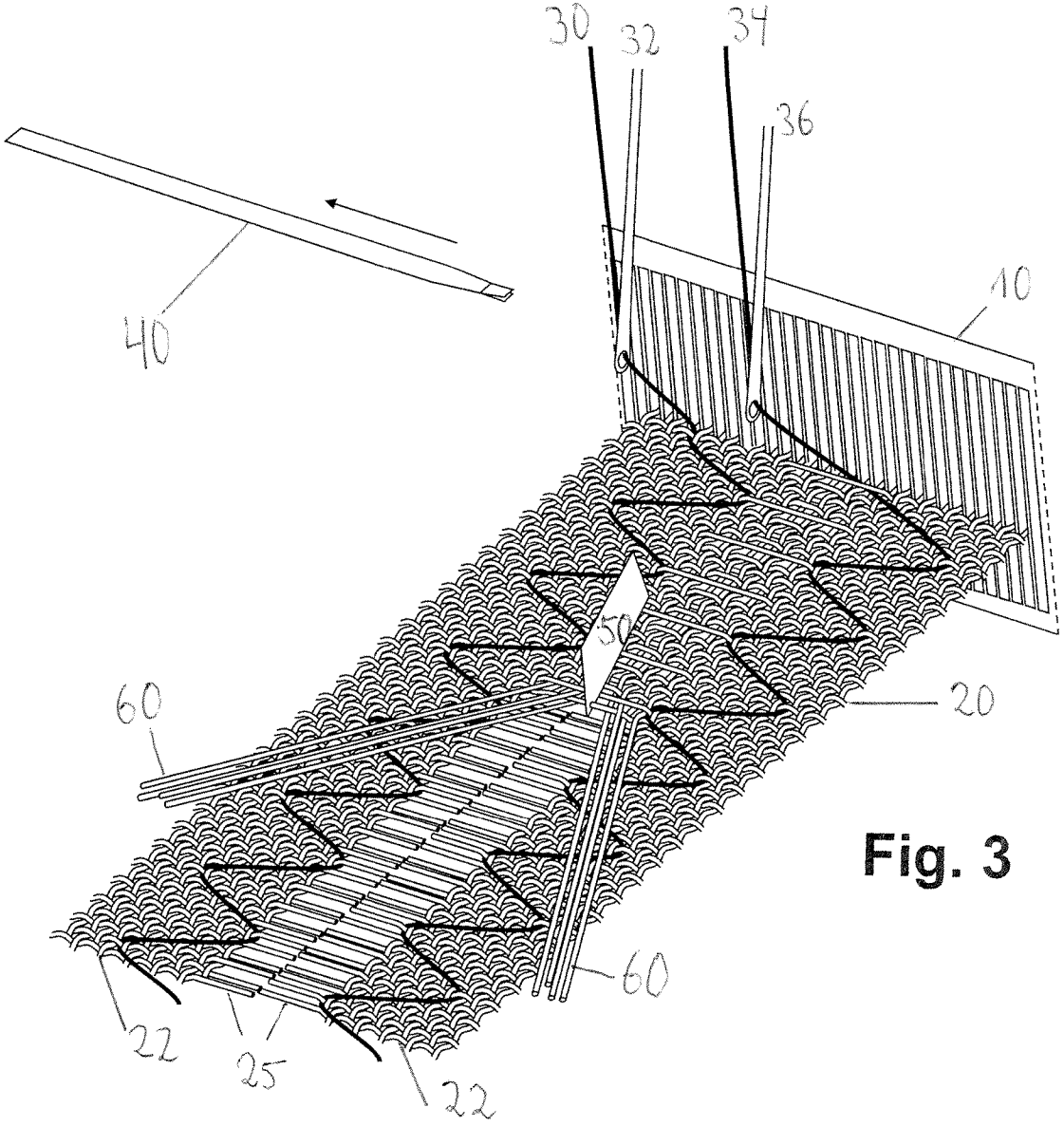
FIG. 3 the cutting process, with the pulling-off of the loose warp threads.

FIGS. 1 to 5 show a first, simple embodiment of the invention. As shown in FIG. 1, the weft thread 24 is inserted weft by weft into the open respective warp thread shed 28 by means of a weft thread guide 40, whereby in the embodiment example the weft thread guide 40—not shown in FIG. 1—transfers to a transfer gripper and thus produces the base woven fabric 20—by means of beating through the reed 10. According to the invention, the zigzag shaped cover threads or effect threads 30, 34 are inserted by means of a plurality of feed needles or reed hooks 34, 36. For this purpose, one of the known methods and devices, respectively, is used. The insertion of such cover threads or effect threads 30, 34 is already described in its principles in CH 490541 A. However, in the embodiment of the invention, the cover threads or effect threads 30, 32 are introduced into the shed or warp thread shed 28 from above by means of feed needles or reed hooks 32, 36 in such manner that they are overstitched by the weft thread insertion device 40 and thereby are bound into the woven fabric 20. This binding of the zigzag threads into the woven fabric by means of binding the corner points of the zigzag pattern into the woven fabric prevents a later fraying from the outset. The feed needles 32, 36 are arranged between the reed beat-up and the reed 10. The reed 10 is closed at the top as usual. Alternatively, the zigzag laying can also be carried out as described in WO 2011/095262 A1, according to which the feed needles are not arranged between the reed beat-up and the reed 10, but between the reed 10 and the shed forming device, and the reed 10 has upwardly open reed teeth. In the exemplary embodiment for laying a zigzag arrangement, the two feed needles 32 and 36 shown here, which form only an illustrative section of the overall device, together with a further feed needle, not shown here, are synchronously guided back and forth in and against the weft insertion direction, as shown in FIGS. 2 and 3.

FIG. 3 additionally shows the cutting tool. By means of the cold cutting tool 50, which in the present embodiment is but a simple cutting knife, the woven material 20 is cut in the region of the fabric take-off into a plurality of woven fabric tapes 22, noting that in FIG. 3 only the cutting interface between two of these woven fabric tapes 22 is shown. In the exemplary embodiment, the cutting process is carried out centrally between the two end points of the zigzag arrangement facing the cutting knife 50. In the exemplary embodiment, the respectively exposed four warp threads 60 are then pulled off laterally at an angle, so that the remaining weft thread regions form weft thread tails 25—which are approximately 1 mm long in the embodiment example—which, on the one hand, already prevent the additional cover threads 30, 34 from fraying, since they are held in tension, and which, on the other hand, form a velvet-like finish to the respective woven fabric strips 22.

Figure 4:
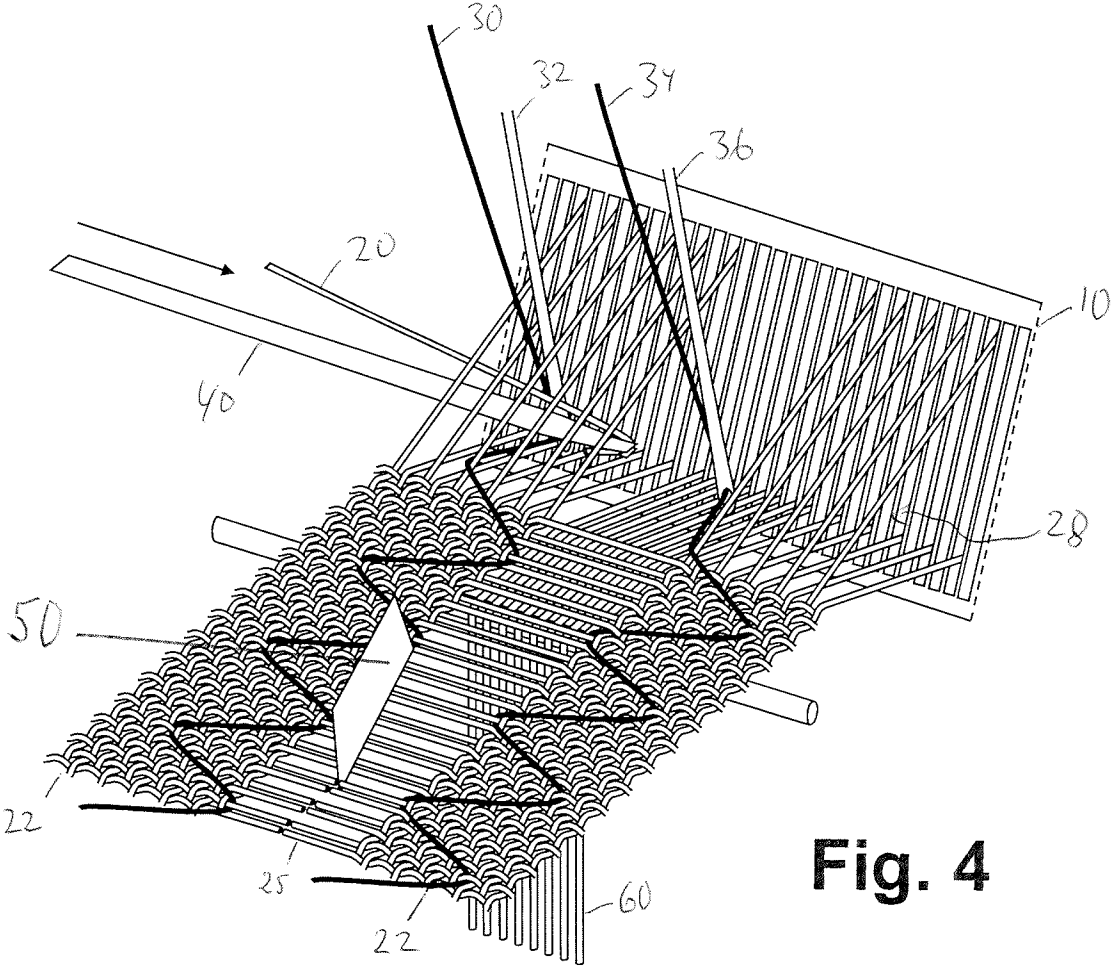
FIG. 4 the cutting process in a first alternative embodiment, in which the warp threads between the cutting device and the fabric edge remain in the low shed during the entire weaving process and are pulled off downwards independently of the cutting process.

In a first alternative embodiment—as shown in FIG. 4—the superfluous warp threads between the cutting device and the fabric edge 26 are pulled off downwards independently of the cutting device 50, thus forming the weft tails 25. In the present embodiment, this is made possible by the fact that these warp threads remain in the low shed during the entire weaving process and therefore never pass above the weft threads. All other steps of the process—in particular the steps relating to the cover threads—are carried out in exactly the same way as in the first embodiment.

Figure 5:
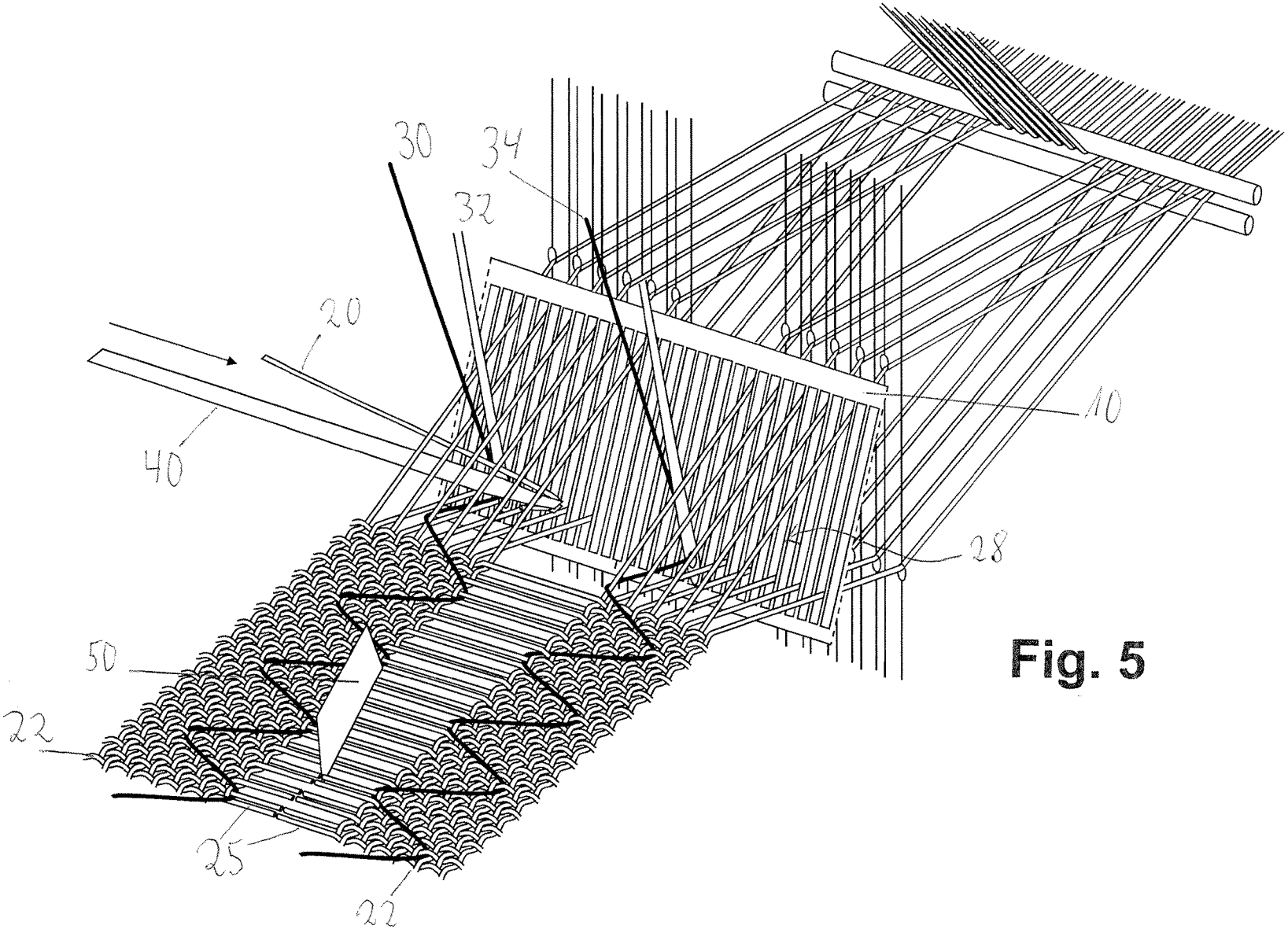
FIG. 5 the cutting process in a second alternative embodiment, in which the warp threads between the cutting device and the fabric edge are pulled off upwards already before the shed.

In a second alternative embodiment—as shown in FIG. 5—the superfluous warp threads between the cutting line and the fabric edge 26 are already drawn off upwards before the reed—also independently of the cutting device 50—, that means, they are not bound in at all. As a result, the weft thread tails are formed in this exemplary embodiment. All other steps of the process—in particular the steps relating to the cover threads—are carried out in exactly the same way as in the first embodiment.

Figure 8:
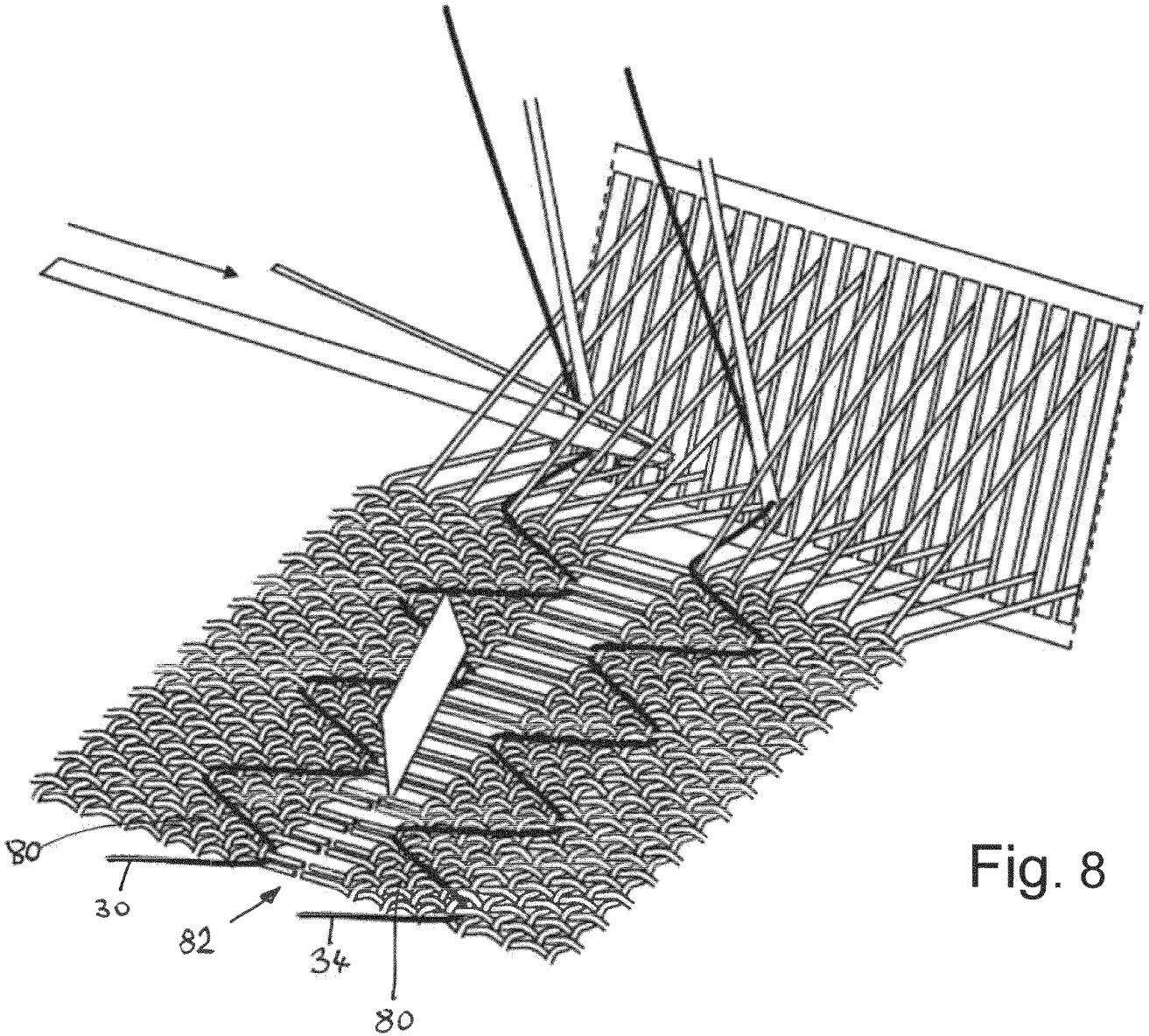

In a preferred embodiment of the present invention—as shown in FIG. 8—the cover threads 30, 34 are inserted under such high tension that the warp threads being bound by them are drawn together in a region 80 in weft direction in such a strong manner that a cutting path 82 is formed and no excess warp threads need to be pulled off. Due to the resulting cutting path, the cutting device 50 is thus so far away from the nearest warp threads so that these cannot be damaged. Also in this embodiment, the weft thread tails 25 are formed by drawing the warp threads together.

In one embodiment of the method of the present invention, for at least one of the threads used, that means the cover thread, the weft thread or the warp thread, a thermally fixable thread is used in the region of the fabric edge and is thermally fixed, for example, by being slightly melted on its surface and thereby being mechanically fixed with the other threads.

In an extended embodiment of the invention, the cover thread 30, 32 is fused with the weft threads on the underside of the woven fabric by means of a heating element. In this process, fusible cover thread and weft threads and possibly warp threads, are used and connected by fusing to form an even more secure fabric edge. Thereby, it should be emphasized that, in contrast to the prior art, in which the separation is carried out by hot cutting, the threads themselves are not damaged, but just only partially melted on their surface. Therefore,—with careful handling—this also does not result in the described disadvantages of hot cutting.

In an extended embodiment of the invention, for at least one of the threads being used, a hot-melt adhesive is employed, and the zigzag structure is hot-adhered at the point of the fabric edge by means of a heating element at temperatures below the melting point of the threads—provided that fusible threads are used, which is not necessary in this exemplary embodiment.

Figure 6:
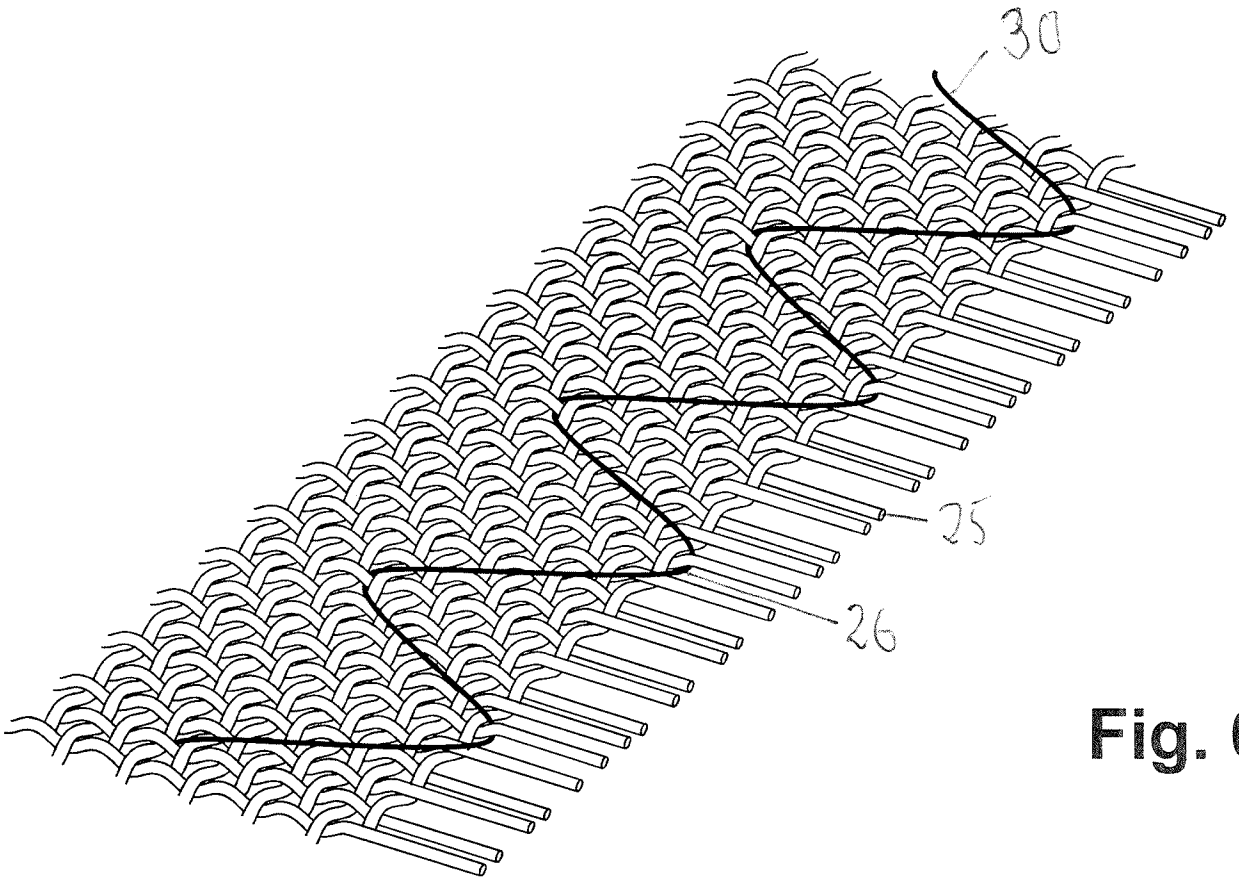
FIG. 6 the situation of the zigzag thread, which is already held in place by the weft thread tails.
Figure 7:
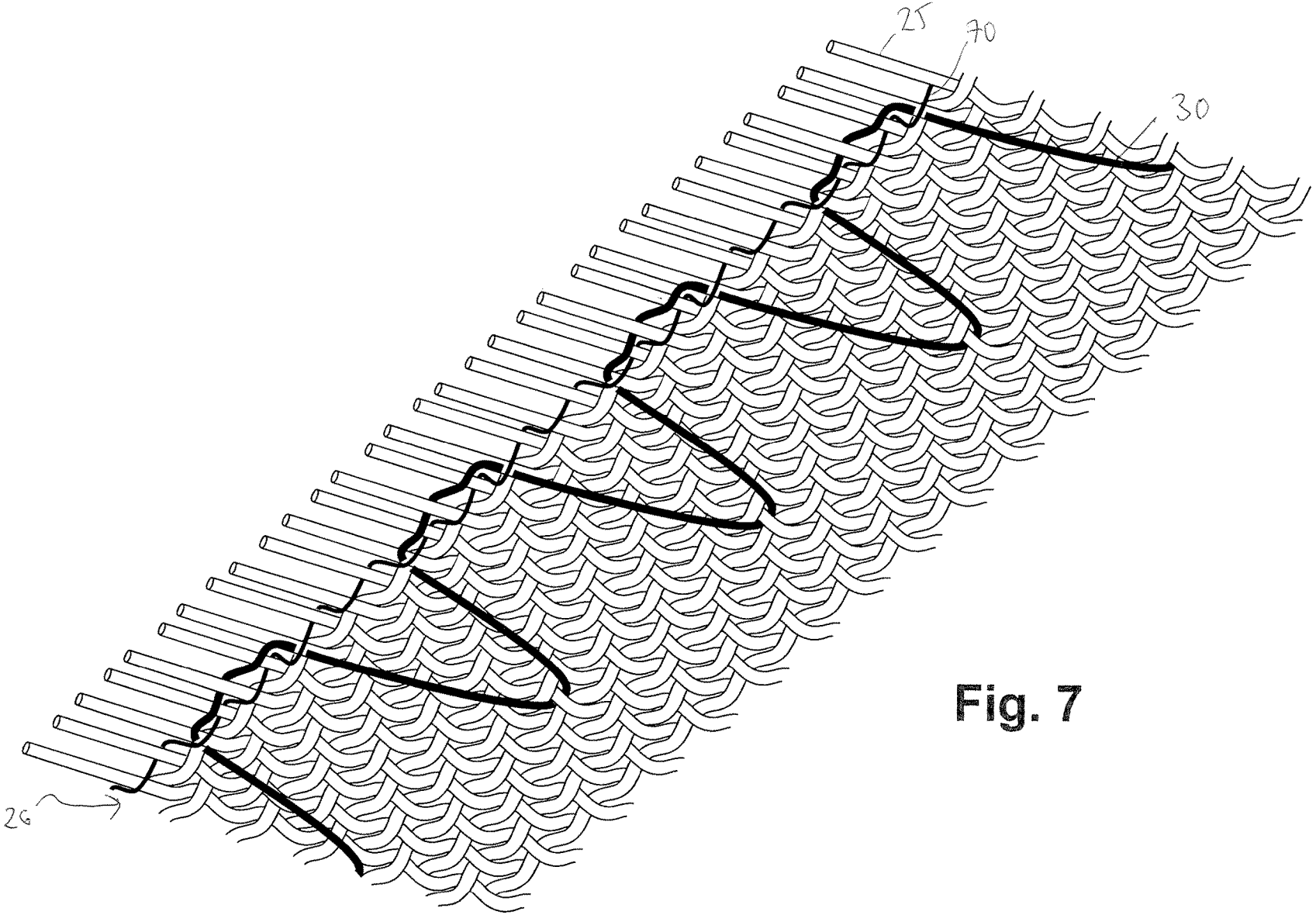
FIG. 7 the situation of the zigzag thread, which is fixed by an additional cover thread independent of the weft thread tails, and FIG. 8 an embodiment in which the cover threads are inserted under high tension.

In FIGS. 6 and 7, a further securing of the fabric edge 26 of the woven fabric strips 22 is illustrated, namely in FIG. 6 without such securing and in FIG. 7 with such securing. As shown in FIG. 6, the fabric edge 26 is secured to the extent that the cover thread 30, 34 is under tension on its side facing the cutting edge to such an extent that it does not extend over the corresponding weft thread tail 25. Without additional securing measures, such as, for example, the aforementioned melting or hot-adhering, it is however, possible, in the event of careless handling of the woven fabric tape 22, in particular through improper manipulation, that individual ends of the zigzag thread are brought over the weft thread tail 25 and thus the fabric edge 26 is damaged. This can be prevented—either in addition to the above-described measures of melting or hot-adhering, but also as a stand-alone measure—by means of a further cover thread 70, which is introduced with a further feed needle. In this embodiment, this additional cover thread 70 has the effect that the respective zigzag thread 30 or 34 is bounded and thus secured with respect to the weft thread 24 or with respect to the weft thread tail 25. Thereby, the additional cover thread 70 lies in warp thread direction substantially between the last remaining warp thread and the first loose warp thread 60 and thus forms the end of the fabric edge 26. However, the additional cover thread can in turn also adopt a zigzag arrangement and does not necessarily form the end of the fabric edge. Its essential function, however, is that it additionally secures ("knots") the binding points between the cover thread 30, 34 and the weft thread 24 in order to prevent the zigzag thread 30, 34 from slipping off.

LIST OF REFERENCE NUMERALS

10 reed
20 woven fabric
22 woven fabric strips
24 weft thread
25 weft thread tail
26 fabric edges
28 warp thread shed
30 first cover thread
32 first feed needle
34 second cover thread
36 second feed needle
40 weft thread guide
50 cold cutting tool
60 loose warp threads after the cutting process
70 additional cover thread for attaching the zigzag thread
80 region of drawn or compressed warp threads
82 cutting path

The invention claimed is:

1. A method for producing a plurality of woven fabric strips by means of a weaving loom, wherein the weaving loom comprises at least a weft thread insertion device, a reed or an equivalent means, a plurality of laying devices for additional cover threads and at least a cold cutting tool for cutting of the woven material into woven fabric strips, comprising the steps of inserting weft threads into an open warp thread shed, laying a plurality of cover threads by means of a plurality of feed needles, cold cutting of the woven fabric in take-off direction into a plurality of woven fabric strips, whereby the cold cutting avoids partially or completely melting through threads of the woven fabric strips, characterized in that the cover threads are laid in a zigzag manner and are introduced into the warp thread shed from above through the feed needles in such manner that said cover threads are overstitched by the weft thread insertion device and thereby are bound into the woven fabric by means of the weft threads.

2. The method according to claim 1, characterized in that weft thread tails are formed by the cold cutting step or after the cold cutting step.

3. The method according to claim 2, characterized in that the weft thread tails are formed in such manner that in a further step the woven warp threads that are located between the cutting-side laying points of said cover threads and the cutting device are pulled off.

4. The method according to claim 2, characterized in that the weft thread tails are formed in such manner that the warp threads that are located between the cutting-side laying points of said cover threads and the cutting edge are permanently maintained in the low shed during the weaving process and the pulling off takes place downwards between the reed and the cutting device.

5. The method according to claim 2, characterized in that the weft thread tails are formed in such manner that the warp threads that are located between cutting-side laying points of said cover threads and cutting edge are pulled off upwards or downwards already before the shed.

6. The method according to claim 2, characterized in that the weft thread tails are formed in such manner that the cover threads are inserted under such high tension that the warp threads being bound by said cover threads are drawn together in weft direction in a region whereby a cutting path is formed and no excess warp threads need to be pulled off.

7. The method according to claim 1, characterized in that a distance between cutting-side laying points of said cover threads and the cutting tool is at least 0.2 mm.

8. The method according to claim 1, characterized in that the weft threads to be cut cold are not meltable.

9. The method according to claim 1, characterized in that the woven fabric is fixed in a region of a cutting point by heating.

10. The method according to claim 1, characterized in that at least of the cover threads, weft threads or warp threads located at a cutting-side laying point is thermally meltable.

11. The method according to claim 1, characterized in that the cover thread is fused with the weft threads, the underside of the woven fabric, by means of a heating element.

12. The method according to claim 1, characterized in that at least one of the woven fabric's threads is provided with a hot-melt adhesive coating and that the zigzag structure is hot-adhered by means of a heating element, at temperatures below a melting point of the threads used in the fabric structure.

13. The method according to claim 1, characterized in that in addition to the cover thread introduced in zigzag manner, a further cover thread is introduced at each fabric edge by means of a further feed needle in such manner that said further cover thread is connected to the zigzag thread whereby the zigzag thread is prevented from fraying.

14. The method according to claim 13, characterized in that prior to cutting, the woven fabric is fixed in a region of a cutting point by heating, the additional cover thread being thermally meltable.

15. The method according to claim 13, characterized in that the additional cover thread is fused with the weft threads and/or to the cover threads, on the underside of the woven fabric, by means of a heating element.

16. The method according to claim 13, characterized in that the additional cover thread (70) is provided with a hot-melt adhesive coating and the zigzag structure is hot-adhered by means of a heating element, at temperatures below the melting point of the threads used in the fabric structure.

17. The method according to claim 14, characterized in that the additional cover thread is fused with the weft threads and/or to the cover threads, on the underside of the woven fabric, by means of a heating element.

18. The method according to claim 14, characterized in that the additional cover thread is provided with a hot-melt adhesive coating and the zigzag structure is hot-adhered by means of a heating element, at temperatures below the melting point of the threads used in the fabric structure.

19. The method according to claim 15, characterized in that the additional cover thread is provided with a hot-melt adhesive coating and the zigzag structure is hot-adhered by means of a heating element, at temperatures below the melting point of the threads used in the fabric structure.

20. The method according to claim 2, characterized in that the weft threads to be cut cold are not meltable.

* * * * *